US005955968A

United States Patent [19]

Bentrott et al.

[11] Patent Number: 5,955,968

[45] Date of Patent: Sep. 21, 1999

[54] EMERGENCY VEHICLE COMMAND AND CONTROL SYSTEM FOR TRAFFIC SIGNAL PREEMPTION

[75] Inventors: Donald W. Bentrott, San Diego; Donald Brown, La Mesa; Jimmie R. Asbury, Imperial Beach; Roger J. Schlichtig, Encinitas, all of Calif.

[73] Assignee: Interlog, Inc., Falls Church, Va.

[21] Appl. No.: 08/785,335

[22] Filed: Jan. 16, 1997

Related U.S. Application Data

[ 60] Provisional application No. 60/009,959, Jan. 16, 1996.

[51] Int. Cl.[6] ..... G08G 1/07

[52] U.S. Cl. ..... 340/906; 340/902; 455/67.5; 455/32.1

[58] Field of Search ..... 340/906, 907, 340/904, 909, 539, 902; 455/67.5, 67.1, 133, 227, 228, 32.1

[56] References Cited

U.S. PATENT DOCUMENTS

| | | | |
|---|---|---|---|
| 4,223,295 | 9/1980 | Bonner et al. | 340/902 |
| 4,228,419 | 10/1980 | Anderson | 340/902 |
| 4,914,434 | 4/1990 | Morgan et al. | 340/906 |
| 5,014,052 | 5/1991 | Obeck | 340/906 |
| 5,083,125 | 1/1992 | Brown et al. | 340/906 |
| 5,345,232 | 9/1994 | Robertson | 340/906 |
| 5,539,398 | 7/1996 | Hall et al. | 340/906 |
| 5,602,739 | 2/1997 | Haagenstad et al. | 340/906 |

*Primary Examiner*—Donnie L. Crosland
*Attorney, Agent, or Firm*—Banner & Witcoff, Ltd.

[57] ABSTRACT

The present invention provides an emergency vehicle command and control system for preemption of intersection traffic signals. Specifically, the system employs coded microwave transmissions from the emergency vehicle which are received by a scanned antenna array at the intersection and are processed to determine the direction-of-arrival of the signal. Each coded transmission received at the intersection is demodulated and error checked for validity. Valid transmissions are communicated to an intersection controller to preempt traffic signals. The system is also equipped to handle multiple vehicle arrivals and to transmit a coded signal to adjacent or orthogonal intersections to execute around-the-corner preemption control. Additionally, all preemption events may be stored in a memory for later retrieval and analysis.

27 Claims, 8 Drawing Sheets

EMERGENCY VEHICLE COMMAND AND CONTROL SYSTEM FOR TRAFFIC SIGNAL PREEMPTION

This application claims the benefit of U.S. Provisional application Ser. No. 60/009,959 filed Jan. 16, 1996.

FIELD OF THE INVENTION

The present invention relates generally to traffic signal preemption systems. In particular, the present invention is directed to an emergency vehicle command and control system for preempting traffic signals, thereby advantageously controlling traffic at intersections so that emergency vehicles approaching the intersection will be able to negotiate the intersection with minimal interference from general traffic. In an exemplary embodiment, the system of the present invention has the ability to communicate around-the-corner to preset traffic signals in intersections that are in a path orthogonal to an emergency vehicle's direction of travel.

BACKGROUND OF THE INVENTION

Conventionally, urban areas had the ability to control traffic signals via a centralized control network to which all intersections in a given area were connected. As a result of the urban sprawl common to most cities, the majority of traffic light controlled intersections operate independently of any control network as was conventionally found in center city areas. Independent control of the traffic light controlled intersections has been made possible through the advent of embedded processor based traffic light controllers. Accordingly, a majority of the signal controlled intersections now operate on a stand-alone basis, receiving inputs from external sensors, such as, for example, in-ground magnetic vehicle sensors, and the like. Many of these stand-alone intersection controllers are also equipped to receive inputs from intersection preemption systems.

To alleviate the problems associated with getting an emergency vehicle, such as, for example, ambulance, fire engine, police car, and the like, from point A to point B over sure streets in a safe and expeditious manner, a reliable system of preempting intersection traffic control signals along the route of the emergency vehicle is required. To this end, traffic signal preemption systems should ideally provide activation of the traffic control signals at a sufficient distance under all weather conditions to allow sufficient time for the traffic signals to complete their normal cycle, clearing both pedestrians and vehicles from the intersection prior to providing a green light to the emergency vehicle. Early and reliable preemption of the intersection light is also important in dispersing vehicles stopped at the intersection in the path of the emergency vehicle due to a red light.

Existing traffic signal preemption systems that have been installed and are currently in use include a strobe light system that uses the visible light spectrum as the preemptive control link between the emergency vehicle and the intersection. A strobe light based system suffers from many disadvantages, including significant range degradation under adverse weather conditions, such as, for example, heavy fog, rain, snow, or the like. Additional degradation occurs because of the propensity of these systems to accumulate dust and dirt on the optical lens portions thereof, especially at the intersection receiver end of the system.

Another type of system that has been used is a sound activated system that detects approaching sirens and determines the direction of approach to initiate the proper preemption sequence. Sound-based systems suffer significant problems with extraneous background or ambient noise causing false alarms to the system, thereby exacerbating the intersection's function, especially where there is no emergency vehicle approaching.

U.S. Pat. No. 4,228,419 to Anderson is directed to an emergency vehicle traffic control system. The system of Anderson uses a microwave transmitter mounted on each emergency vehicle in the system. The emergency vehicle emits a pulse coded message that is received by a permanently fixed receiver at each intersection to be controlled. The receiver includes a plurality of directional antennas that face the various directions to be controlled, thereby automatically discriminating a direction of approach of the emergency vehicle. The receiver further includes circuitry to verify that the preemption request has been transmitted by an authorized user. The system is reset by an internal delay based on a time after which a preemption signal is no longer received, which permits the emergency vehicle to clear the intersection. The system of Anderson relies on bulky and aesthetically unpleasing directional horn antennas mounted on the traffic signal. Additionally, the system relies heavily on built-in delays and cannot control closely located orthogonal intersections.

Further examples of traffic signal preemption signals are found in U.S. Pat. Nos. 5,014,052 and 4,228,419 to Obeck; U.S. Pat. No. 5,345,232 to Robertson; U.S. Pat. No. 4,223,295 to Bonner et al.; U.S. Pat. No. 4,573,049 to Anderson; U.S. Pat. No. 5,083,125 to Brown et al.; and U.S. Pat. No. Re 28,100 to Long.

Those skilled in the art will understand and appreciate the shortcomings of the foregoing conventional systems that do not provide any ability of the traffic preemption system to "see" around corners and to provide sufficient time for preemption and clearing of the intersection to be controlled.

SUMMARY OF THE INVENTION

The present invention provides an improved emergency vehicle command and control system for traffic signal preemption that overcomes the deficiencies of known traffic signal preemption systems. In particular, the present invention provides an emergency vehicle command and control system for traffic signal preemption that includes the ability to control closely located orthogonal intersections, and that does not suffer significant range degradation due to adverse environmental conditions.

It is therefore, an object of the present invention to provide an emergency vehicle command and control system for traffic signal preemption that does not suffer significant range degradation due to adverse weather conditions, such as, for example, heavy fog, rain, snow, etc.

It is another object of the present invention to provide an emergency vehicle command and control system for traffic signal preemption that has the ability to communicate "around-the-corner" to preset traffic signal lights in a path orthogonal to the current direction of travel of the emergency vehicle.

It is yet another object of the present invention to provide an emergency vehicle command and control system for traffic signal preemption that activates that system from a sufficient distance to allow the system to clear the controlled intersection prior to arrival of the emergency vehicle.

Another object of the present invention is to provide an emergency vehicle command and control system for traffic signal preemption wherein the system has the ability to discriminate between multiple emergency vehicles approaching the same intersection at the same time, and prioritizing the traffic signal preemption based on a priority of the vehicle and/or the proximity of the vehicle to the intersection.

It is a further object of the present invention to provide an emergency vehicle command and control system for traffic signal preemption that uses a scanned antenna array for detecting the signals from the emergency vehicle. Using a scanned antenna array provides functional advantages not available when using conventional dedicated directional antenna arrays.

Another object of the present invention is to provide an emergency vehicle command and control system for traffic signal preemption that is capable of determining whether the emergency vehicle is going to execute a turn at the intersection, and using data indicative of a turning direction to control adjacent and orthogonal intersections as required.

It is yet another object of the present invention to provide an emergency vehicle command and control system for traffic signal preemption that includes a system to provide preemption range control by requiring that incoming received signal level exceed a press threshold level before beginning processing of the signal. The system would also inhibit further processing if the incoming signal falls below the preset threshold.

A further object of the present invention is to provide an emergency command and control system for preemption of traffic signals that has a memory in which the system has the option of automatically logging all preemption events thus enabling later audit and performance analysis functions, and the like.

Yet another object of the present invention is to provide an emergency command and control system for preemption of traffic signals that is locally programmable via software downloads or direct programming via a portable computer, such as, for example, a laptop computer or the like.

These and other objects, and their attendant advantages, are achieved by the present invention, which provides an emergency vehicle command and control system for traffic signal preemption, comprising: a transmitter for transmitting a traffic signal preemption signal; a scanned antenna array for intercepting said traffic signal preemption signal; a receiver/transmitter for receiving said traffic signal preemption signal, said receiver/transmitter operatively coupled to said scanned antenna array; a microprocessor controller operatively coupled to said receiver/transmitter; and a controller processor operatively coupled to said receiver/transmitter and an intersection signal controller.

BRIEF DESCRIPTION OF THE DRAWINGS

The invention will be described in detail herein with reference to the following drawings in which like reference numerals refer to like elements, and wherein.

DETAILED DESCRIPTION OF PREFERRED EMBODIMENTS

Figure 1:
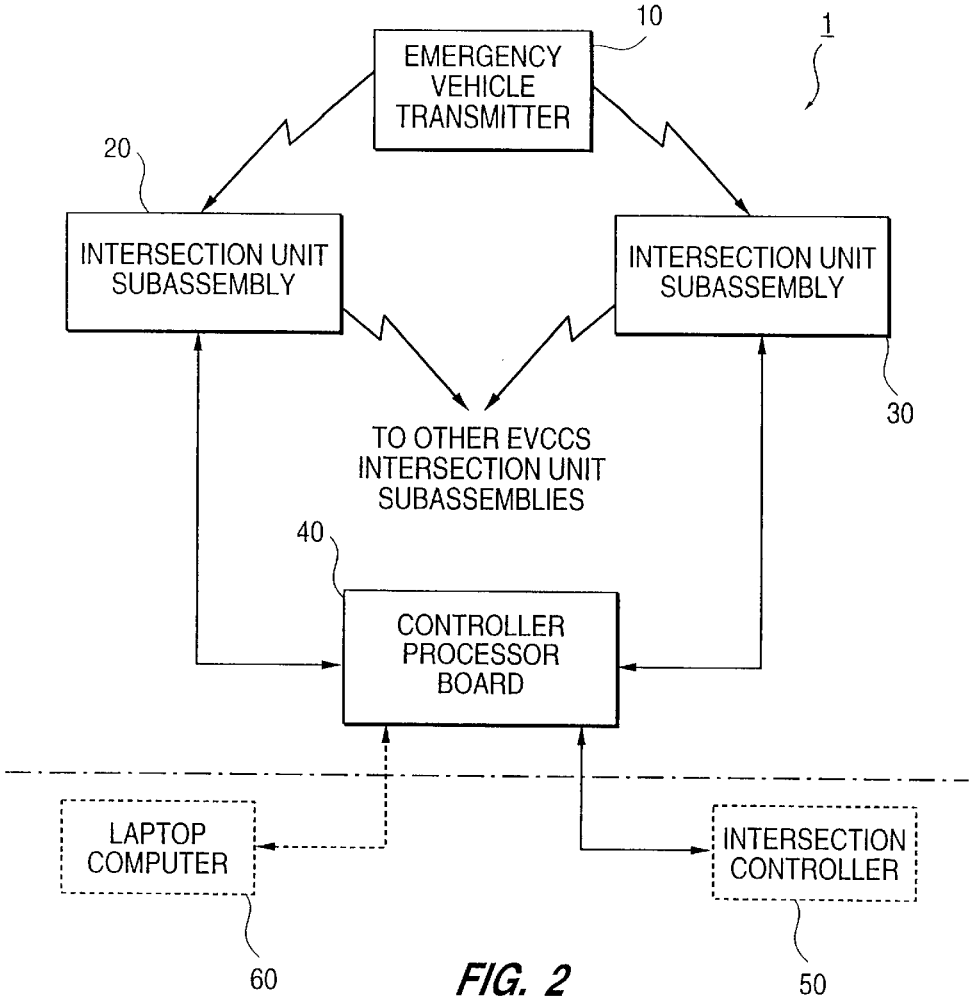
FIG. 1 is a block diagram of the emergency vehicle command and control system for traffic signal preemption according to an embodiment of the present invention.

With reference to FIG. 1, a block diagram of the emergency vehicle command and control system (EVCCS) for traffic signal preemption 1 generally comprises four primary subassemblies. These subassemblies include the Emergency Vehicle Transmitter (EVT) 10, two identical Intersection Unit Subassemblies 20, 30, and a Controller Processor 40. The EVCCS 1 is operatively connected to communicate bidirectionally with a known intersection controller 50, such as, for example, a Model 170 Intersection Controller, or the like. Additionally, the controller processor 40 includes an interface (not shown) for communicating with a computer, such as, for example, a laptop computer 60 or personal computer, or the like. In a preferred embodiment, the communications between the EVT 10 and the intersection unit subassemblies 20, 30 is an air-link operating in the microwave frequency range.

As illustrated in FIG. 1, either the EVT 10 or the intersection unit subassemblies 20, 30 may originate radio frequency transmissions that communicate to EVCCS intersection unit subassemblies. In the case where the EVT 10 acts as the transmission originator, transmissions are received by the intersection unit subassemblies 20, 30 that are in the path of an emergency vehicle. Where intersection unit subassemblies 20, 30 are the transmission originators, transmissions are received by selected intersection unit subassemblies 20, 30 of adjacent or orthogonal intersections. In either event, the radio frequency transmissions are preferably in the microwave frequency range and are made up of 4.8 millisecond bursts of coded pulse-width modulated data. It will be understood, however, that any frequency range and data modulation scheme known to one of ordinary skill in the art would be suitable, and that the specific descriptions contained herein are illustrative and not limiting. The bursts are received by a scanned antenna array, described in detail with reference to FIGS. 4 and 5 below, that is integral to the intersection unit subassemblies 20, 30 at a given intersection. The bursts are initially processed by the intersection unit subassembly 20, 30 to determine signal direction-of-arrival, and are further processed by the controller processor 40 for final signal direction-of-arrival and data content processing. Based on data correlation of multiple transmissions and transmitted bit validation, described in detail below, the controller processor 40 issues an appropriate discrete preemption command to the traffic control system's intersection controller 50. The intersection controller 50 then controls the signaling at the given intersection in an appropriate manner. Additionally, the controller processor 40 may subsequently record, in non-volatile memory, pertinent selected data relative to the preemption event such that a laptop computer 60, or the like, can be interfaced to the controller processor 40 for data extraction of the stored preemption event records. By recording preemption event data, audits of system performance and the like may be conducted to evaluate and improve the system.

Figure 8:
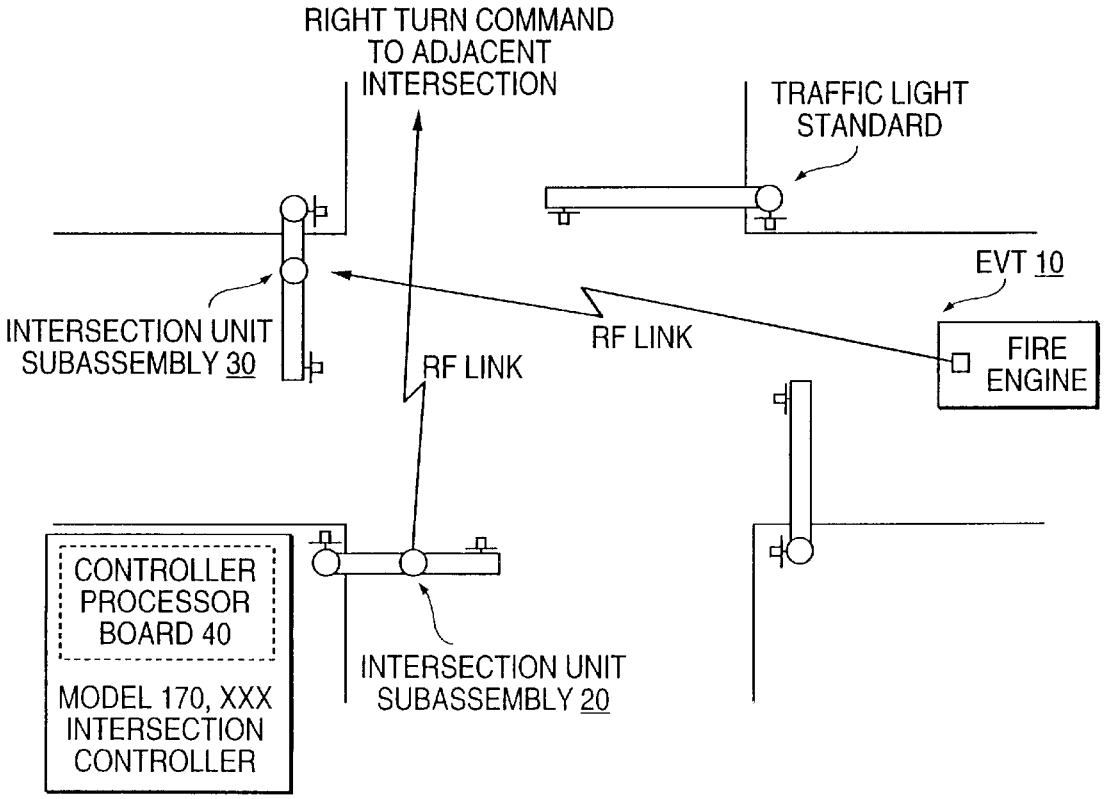
FIG. 8 is an overhead view of an intersection in which the emergency vehicle command and control system for traffic signal preemption of the present invention is installed.

Interfaces between the intersection unit subassemblies 20, 30 and the controller processor 40 may be any type know to those skilled in the art. In the preferred exemplary embodiment illustrated herein, these interfaces are full duplex type RS-485 interfaces. The interface between the laptop 60 and the controller processor 40 is, for example, full duplex RS-232. Atypical installation of the EVCCS 1 at an intersection is schematically shown in FIG. 8, which will be discussed in greater detail below.

Figure 2:
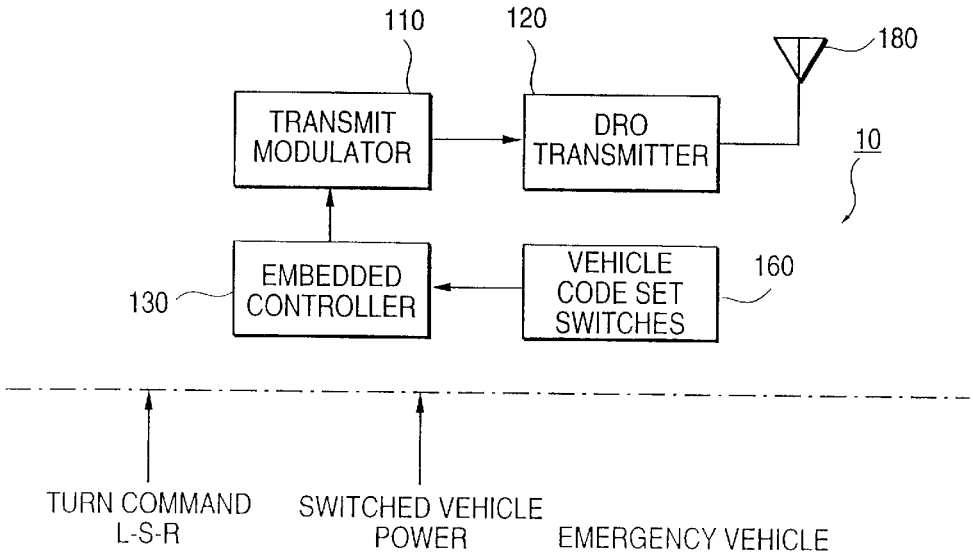
FIG. 2 is a block diagram of the emergency vehicle transmitter of the emergency vehicle command and control system for traffic signal preemption of the present invention.

FIG. 2 is a block diagram of a preferred embodiment of the EVT 10. The EVT 10 includes vehicle code set switches 160, an embedded controller 130, a transmit modulator 110, an transmitter 120 (e.g., a dielectric resonator oscillator (DRO) transmitter) and a directional antenna 180. The vehicle code set switches 160 are used to set specific vehicle related parameters, such as, for example, vehicle identification, and the like, into the coded EVT radio frequency transmission. The embedded controller 130, described in further detail below with reference to FIG. 3, establishes all timing parameters, formats the coded message based on stored parameters and data received from the vehicle code set switches 160 and from the emergency vehicle, such as, for example, turn command discretes left, right, straight, and outputs a formatted serial digital message to the transmit modulator 110. The transmit modulator 110 modulates, e.g., pulse-width modulates, the transmitter 120 in accordance with the data received from the embedded controller 130. The pulse-width modulated radio frequency output from the transmitter 120 is coupled to the antenna 180, which provides, for example, 16 dB gain and a beamwidth of 20° in the H-plane.

Figure 3:
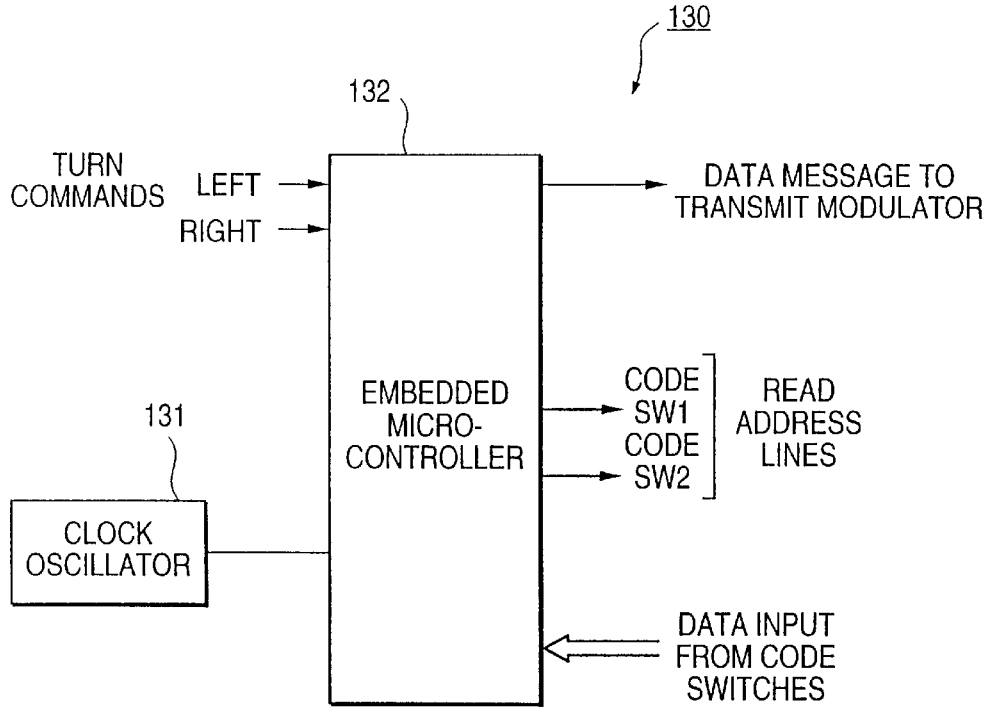
FIG. 3 is a block diagram of the embedded controller of the emergency vehicle transmitter shown in FIG. 2.

Details of the embedded controller 130 are shown in the block diagram of FIG. 3. The embedded controller 130 includes a clock oscillator 131 and in embedded microcontroller 132. The embedded microcontroller 132 receives the turn command discretes from the turn signal switches (not shown) of the emergency vehicle (not shown), on one of its input/output ports. All EVT 10 timing is established by the clock oscillator 131. The clock oscillator 131 also establishes the reference for burst interval timing, the bit rate timing and the pulse-width timing of each transmission. The embedded microcontroller 132 and its operating program collect the vehicle code set switch 160 data and the turn command data from its programmed input/output ports. Additionally, the embedded microcontroller 132 formats the coded message and related pulse-widths for transmission while establishing the burst interval based on the reference provided by the clock oscillator 131, and outputs the digital message to the transmit modulator 110 of the EVT 10 for transmission to the desired intersection unit subassemblies 20, 30.

Figure 4:
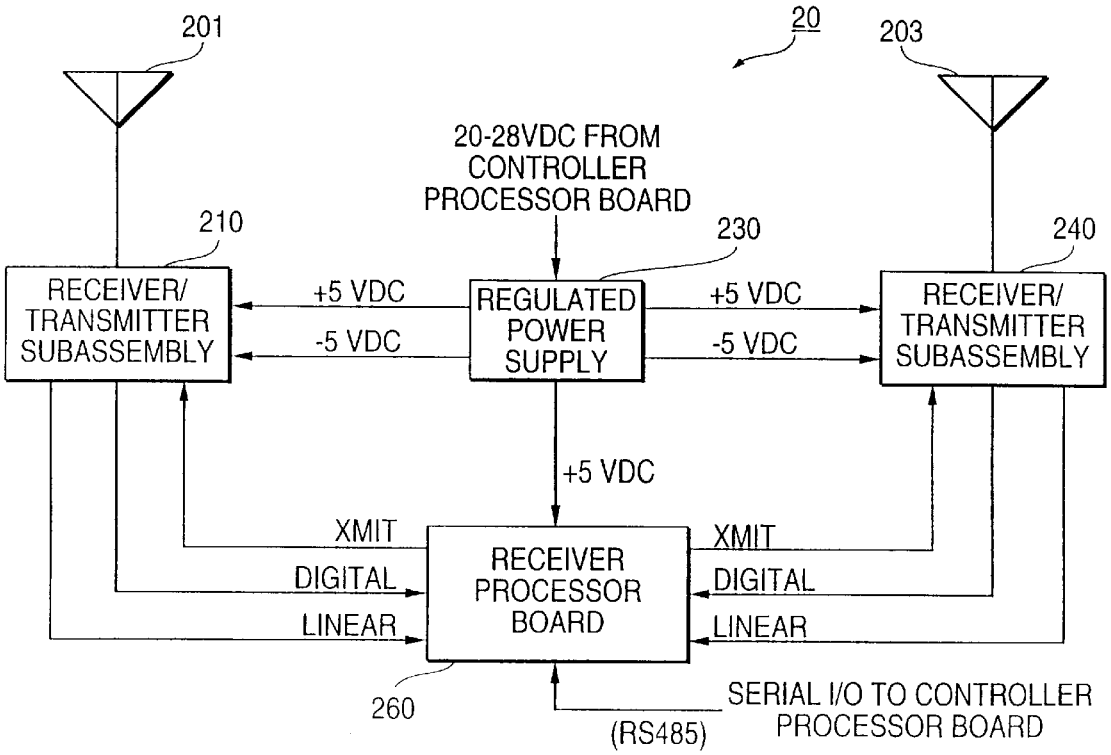
FIG. 4 is a block diagram of the intersection unit subassembly of the emergency vehicle command and control system for traffic signal preemption of the present invention.

FIG. 4 is a schematic block diagram of a preferred embodiment of the intersection unit subassembly 20 or 30 (for simplicity, the reference numeral 20 will be used to refer to the intersection unit subassembly of FIG. 4, however, it will be understood that the following description applies equally to subassembly 30). The intersection unit subassembly 20 receives the coded microwave radio frequency transmission from either the EVT 10 or another intersection unit subassembly via integral, bidirectional antennas, and performs the necessary processing to determine and assign the signal direction-of-arrival to one of two antennas 201, 203 and associated receiver/transmitter subassemblies 210, 240. Received signal level data for the selected antenna is digitized, while demodulated message data is collected and formatted with the signal level data for transmission to the controller processor 40. Each of the intersection unit subassemblies 20, 30 include two identical receiver/transmitter subassemblies 210, 240, a receiver processor 260 and a regulated power supply 230. The regulated power supply 230 converts the 20–28 VDC power from the controller processor 40 to regulated +5 VDC and −5 VDC power. The receiver/transmitter subassembly 210, 240 and the receiver processor 260 are described in greater detail below with reference to FIGS. 5 and 6, respectively.

Figure 5:
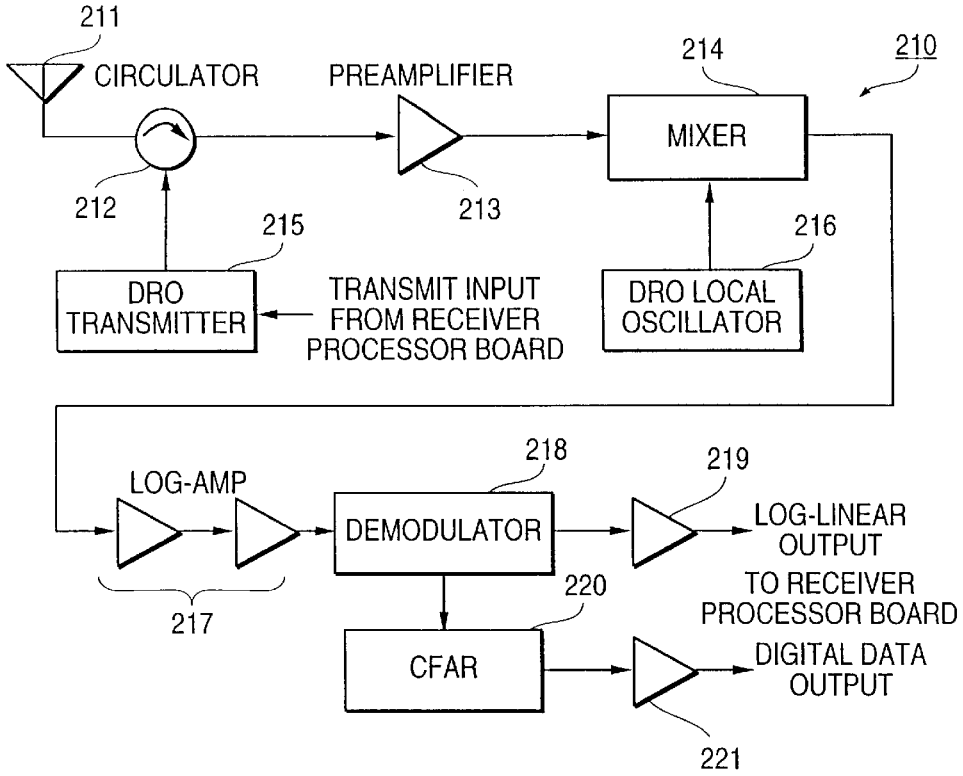
FIG. 5 is a block diagram of the receiver/transmitter subassembly of the emergency vehicle command and control system for traffic signal preemption of the present invention.

FIG. 5 is a schematic block diagram of the receiver/transmitter subassembly 210, 240. As illustrated, a transmission from either the EVT 10 or a second EVCCS 1 intersection unit subassembly 20, 30 is received by a directional antenna 211 of the receiver/transmitter subassembly 210, 240. The antenna 211 preferably has a gain in the range of 22 dB and a beamwidth in the H-plane of 10°. The antenna 211 receives the transmission and passes it to a circulator 212. The circulator 212 performs numerous functions, including passing the received signal to a preamplifier 213, providing a 20 dB attenuation to the undesired emission of a local oscillator 216 frequency, and minimal attenuation of transmission by the transmitter 215. The circulator 212 also supports EVCCS 1 self test functions by providing an attenuated radio frequency feedback path to the receiver to verify system functionality of both the analog and digital functions. The preamplifier 213 amplifies the received signal for input to a mixer 214. The mixer 214 acts to heterodyne the received signal with the signal from the local oscillator 216, to produce an intermediate frequency signal (e.g. 12–18 MHz). The intermediate frequency signal is amplified in a log-amp 217 whose summing bar is the receiver demodulator 218. The log-linear output from the demodulator 218 is amplified and gain adjusted in linear amplifier 219 to produce the log-linear output for transmission to the receiver processor 260. A second output from the demodulator 218 is passed through a constant false alarm rate (CFAR) circuit 220, whose output is connected to a threshold comparator 221 to produce a digital data output for transmission to the receiver processor 260.

Figure 6:
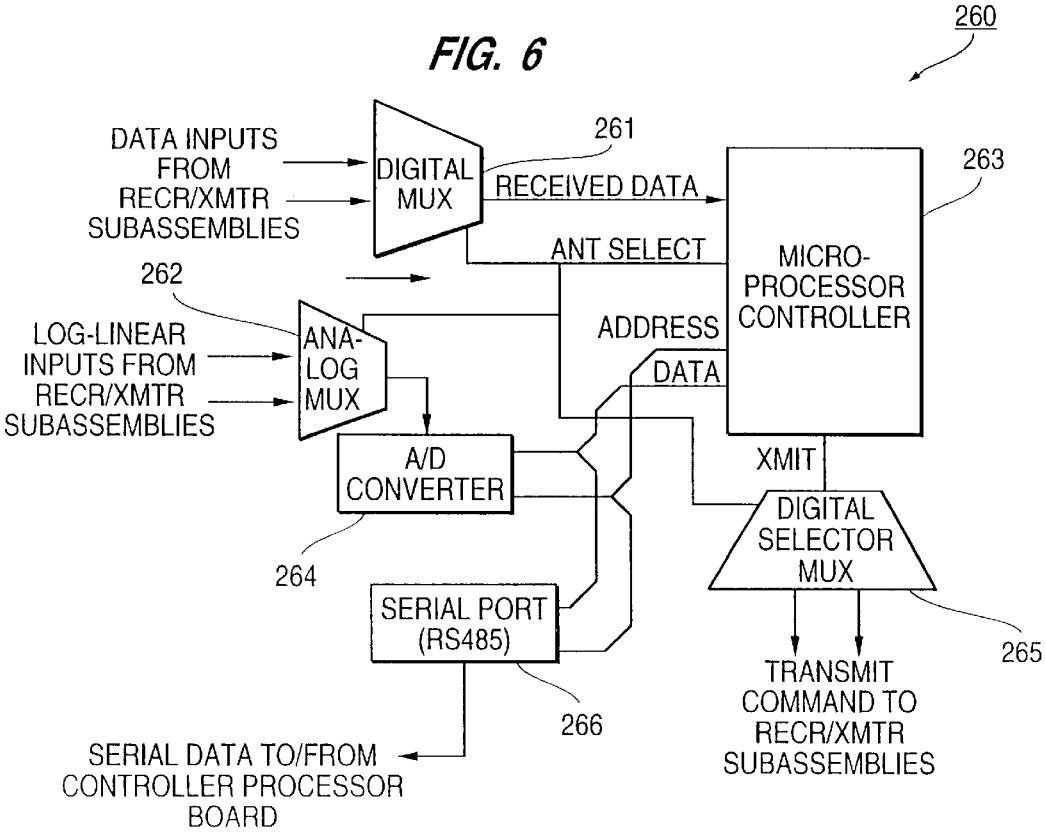
FIG. 6 is a block diagram of the receiver processor board subassembly of the emergency vehicle command and control system for traffic signal preemption of the present invention.

The receiver processor 260, shown schematically in FIG. 6, receives the digital and log-linear data from the receiver/transmitter subassembly 210, 240 for processing. The digital data from the receiver/transmitter subassemblies 210, 240 is routed to a microprocessor controller 263 via a digital multiplexer 261. The digital multiplexer 216 is controlled by an antenna select discrete from the microprocessor controller 263. Similarly, the log-linear data from the receiver/transmitter subassemblies 210, 240 is routed to an eight-bit analog to digital (A/D) converter 264 by an analog multiplexer 262 which is controlled by the antenna select discrete from the microprocessor controller 263. The digital output of the A/D converter 264 is read by the microprocessor controller 263 and formatted with the received digital data message for transmission to the controller processor 40. In the event that a transmission is required by either of the receiver/transmitter subassemblies 210, 240 to execute a right or left turn command from the emergency vehicle (not shown), the microprocessor controller 263, acting upon data received from the controller processor 40, will issue the appropriate antenna select discrete to the digital selector multiplexer 265 and commence the required coded data transmission. Communications between the microprocessor controller 263 and the controller processor 40 is preferably maintained through a full duplex RS-485 port 266.

Figure 9A:
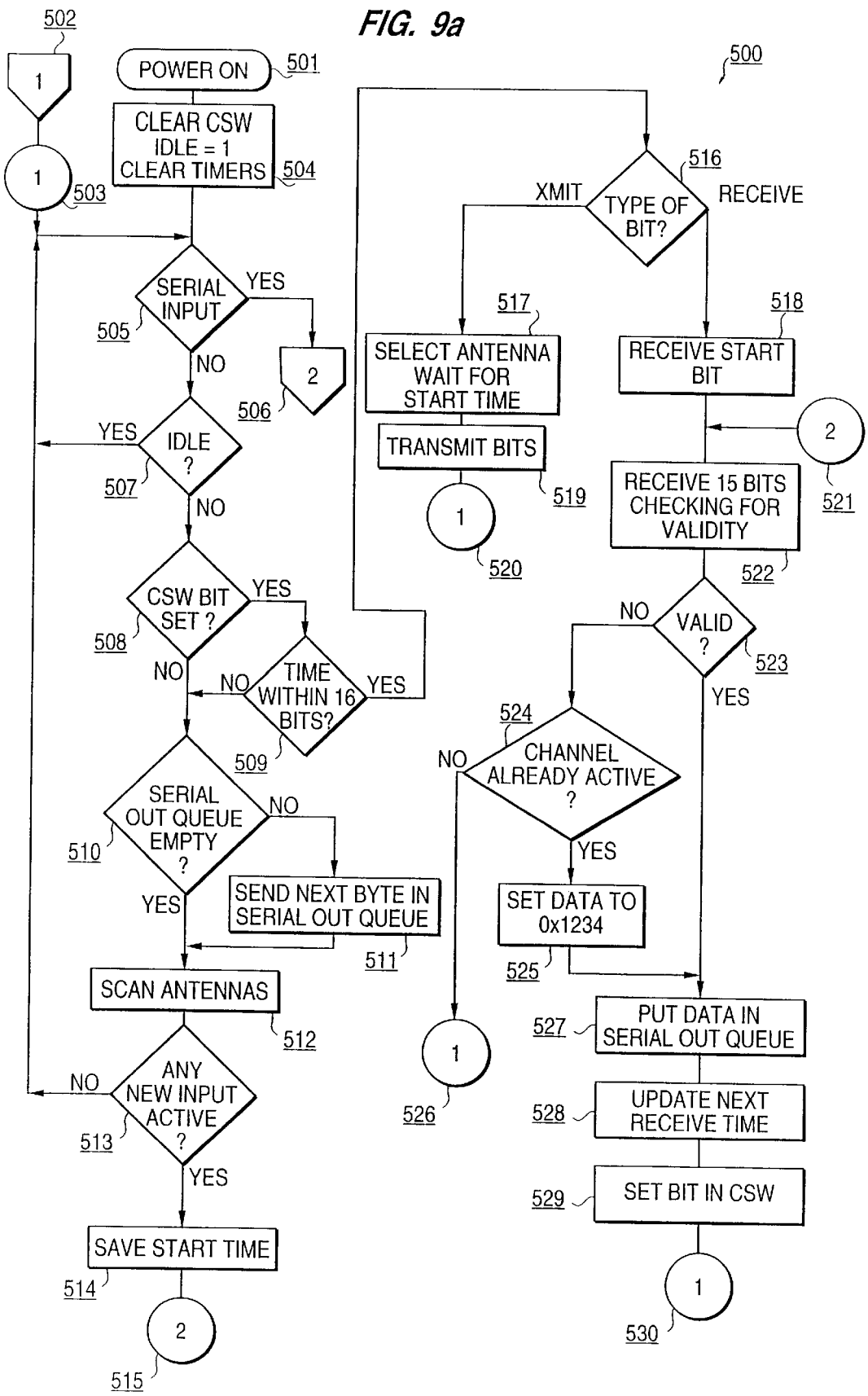
FIGS. 9A and 9B show a flow chart representing the operation of the receiver processor board according to an embodiment of the present invention.
Figure 9B:
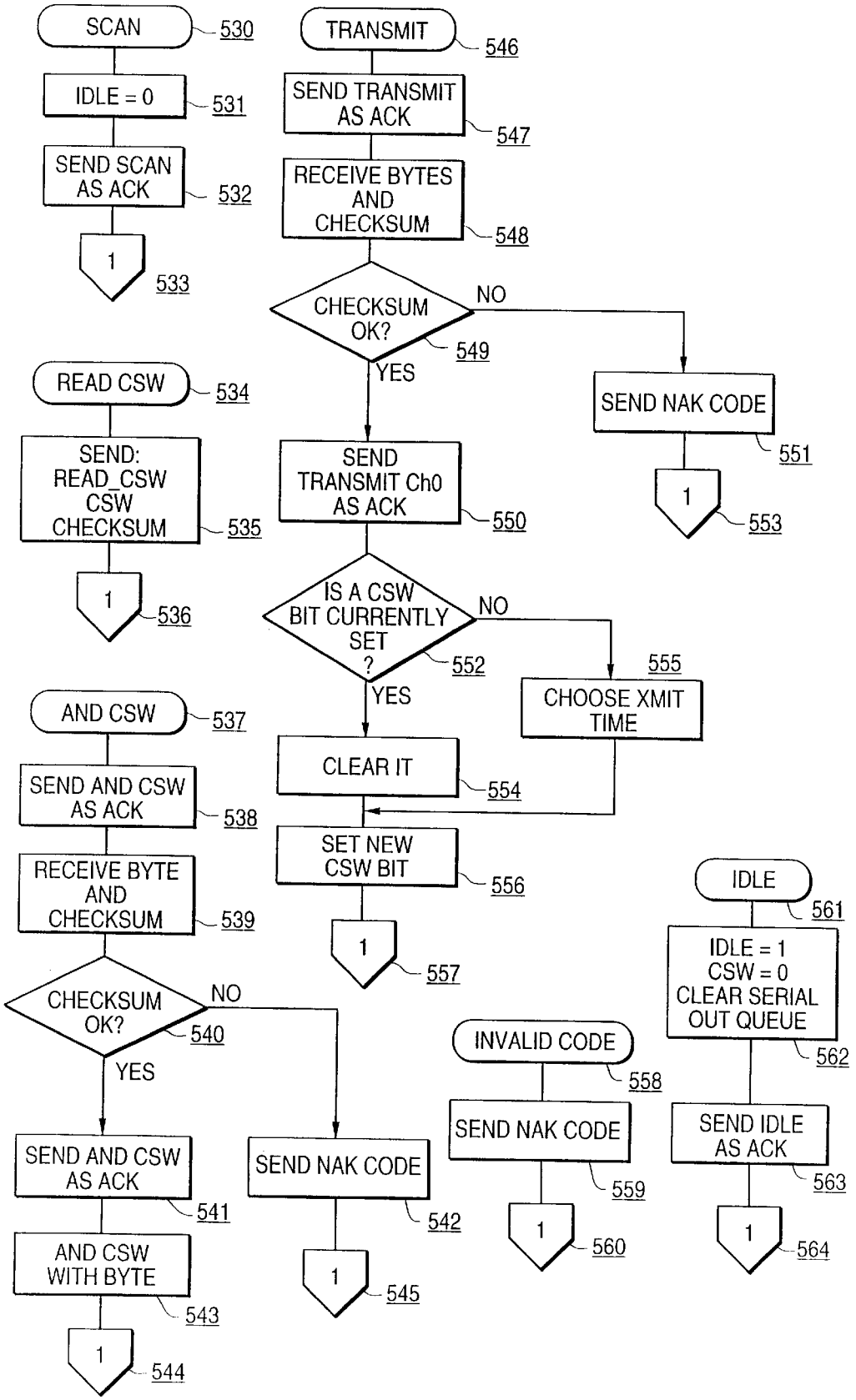

The data processing that is performed by the receiver processor 260 is shown in detail in FIGS. 9*a* and 9*b*. At system power up 501, the microprocessor controller 263 is initialized by clearing the channel status word (CSW), setting the IDLE bit to a logical "one" and clearing all timers 504. The microprocessor controller 263 then looks for a serial input 505 from the controller processor 40. If a serial input is detected, the microprocessor controller 263 reads the serial input which may be any one of the instructions shown in FIG. 9*b*. If the received instruction is to SCAN antennas 530, the microprocessor controller 263 sets the IDLE bit to a logical "zero" 531, sends the SCAN command as an acknowledge (Ack) 532 to the controller processor 40, and then branches 533, 502, 503 back to the serial input 505 of FIG. 9*a*. If the received instruction is to TRANSMIT 546, the microprocessor controller 263 sends the TRANSMIT command as an acknowledge (Ack) 547 and receives the transmit bytes together with the checksum 548. If the checksum does not match 549, the microprocessor controller 263 will output a "not acknowledge" (NAK) code 551, and then branches 553, 502, 503 back to read serial input 505. If the checksum matches 549, microprocessor controller 263 sends a TRANSMIT Ch0 as and acknowledge (Ack) 550 to the controller processor 40. The microprocessor controller 263 then examines the CSW for a bit currently set 552. If no bit is currently set, the microprocessor controller 263 chooses and XMIT time 555 for the current transmission and branches to set a new CSW bit 556 for the current transmission channel. If the microprocessor controller 263 determines that the CSW bit is currently set 552, then the CSW bits are cleared 554 and a new CSW bit is set 556 for the current transmission channel followed by a branch 557, 502, 503 back to read serial input 505. If the instruction is to READ CSW 534, the microprocessor controller 263 sends a READ_CSW, CSW and Checksum 535 to the controller processor 40 followed by a branch 536, 502, 503 back to read serial input 505. If the instruction is to AND CSW 537, the microprocessor controller 263 sends AND CSW as an acknowledge (Ack) 538 to the controller processor 40. The microprocessor controller 263 then receives the byte and Checksum 539 and determines if the Checksum matches 540. If the Checksum does not match, the microprocessor controller 263 sends a NAK code 542 to the controller processor 40 and then branches 545, 502, 503 back to read serial input 505. If the Checksum matches, the microprocessor controller 263 sends an AND CSW as acknowledgment (Ack) 541, performs a logical "and" of the contents of the CSW and the received byte 543 and then branches 544, 502, 503 back to read serial input 505. If the instruction is an INVALID CODE 558, the microprocessor controller 263 sends a NAK code 559 to the controller processor 40, and branches 560, 502, 503 back to read serial input 505. If the instruction is IDLE 561, the microprocessor controller 263 sets IDLE to a logical "1", CSW to a logical "0" and clears the serial out queue 562. The microprocessor controller 263 then sends the IDLE command as acknowledgment (Ack) 563 and branches 564, 502, 503 back to read serial input 505.

If the microprocessor controller 263 finds no serial input 505, it then checks the IDLE state 507. If the microprocessor controller 263 is in the IDLE state 507 the program returns to read serial input 505. If the microprocessor controller 263 is not in the IDLE state 507, it then determines if a CSW bit is set 508. If a CSW bit is set 508, then the microprocessor controller 263 determines if the next function to be performed will start within a time equivalent of 16 bits 509 prior to a previously programmed function. If it is determined that there is no previously programmed function to start within a time period of 16 bits 509, the microprocessor controller 263 determines if the serial out queue is empty 510. If the determination is that the queue is not empty, the microprocessor controller 263 proceeds to send the next byte in the serial out queue 511 with a return to scan antennas 512. If the microprocessor controller 263 determines that the queue is empty, the microprocessor controller 263 executes the scan antennas command 512. During the scan antennas 512 process, the microprocessor controller 263 looks to see if any new input is active 513. If it is determined that there is no new input active 513, the program returns to read serial input 505. If it is determined that there is a new input active 513, the microprocessor controller 263 saves the start time 514 and branches 515, 521 to receive 15 bits and check for validity 522. If the data is found to be invalid 523, the microprocessor controller 263 then determines if the channel is already active 524. If the channel is not already active, the program returns 526, 503 to read serial input 505. If the channel is already active, the microprocessor controller 263 sets the data to 0×1234 525 and branches to put data in the serial out queue 527. After putting data into the serial out queue 527, the microprocessor controller 263 updates the next receive time 528, sets a bit in the CSW 529 and returns 530, 503 to read serial input 505. If the data is found to be valid 523, the microprocessor controller 263 proceeds to put data in the serial out queue 527, update the next receive time 528, set a bit in the CSW 529, and return 530, 503 to read serial input 505.

If it is determined that there is a previously programmed function to start within a time of 16 bits 509, the microprocessor controller 263 reads the CSW for the type of bit 516. If the type of bit is a transmit bit (Xmit), the microprocessor controller 263 selects the antenna for transmission and waits for the start time 517, transmits the bits 519, and returns 520, 503 to read serial input 505. If the type of bit is a receive bit 516, the microprocessor controller 263 receives the start bit 518 and continues processing to receive the remaining 15 bits and to check for validity 522. If the data is found to be invalid 523, the microprocessor controller 263 then determines if the channel is already active. If the channel is not already active, the program returns 526, 503 to read serial input 505. If the channel is determined to be active, the microprocessor controller 263 sets the data to 0×1234 525 and branches to put data in serial output queue 527. After putting data in the serial output queue 527, the microprocessor controller 263 updates the next receive time 528, sets a bit in the CSW 529 and returns 530, 503 to read serial input 505. If the data is found to be valid 523, the microprocessor controller 263 proceeds to put data in the serial output queue 527, update the next receive time 528, set a bit in the CSW 529 and return 530, 503 to read serial input 505.

Figure 7:
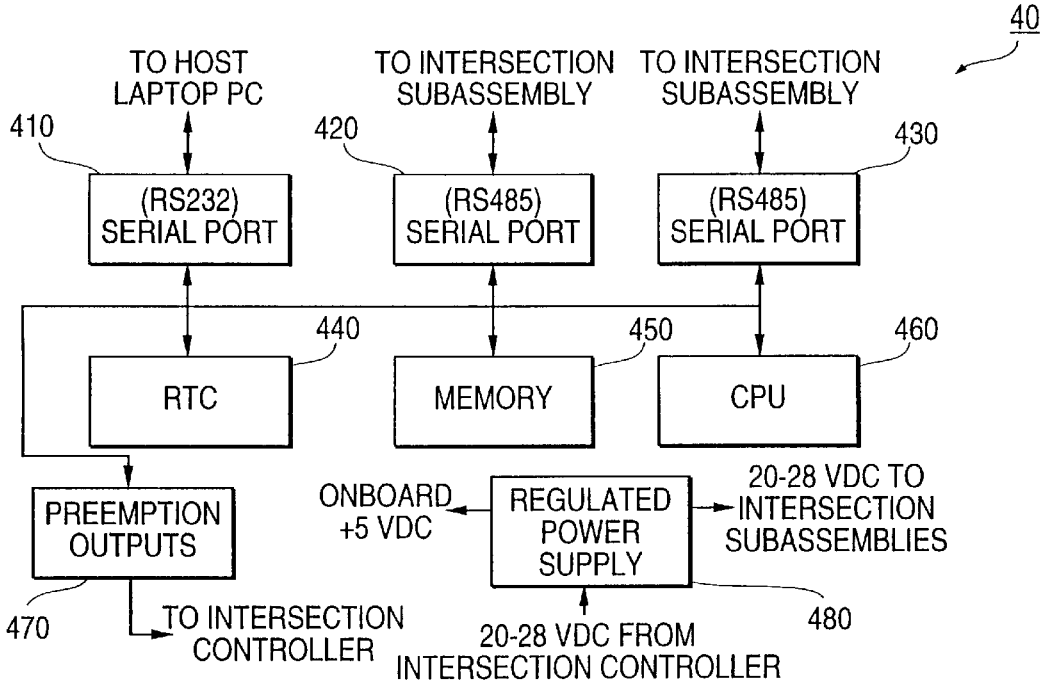
FIG. 7 is a block diagram of the controller processor board of the emergency vehicle and control system for traffic signal preemption of the present invention.

The controller processor subassembly 40 is shown in block diagram form in FIG. 7. The controller processor 40 interfaces with the intersection unit subassemblies 20, 30, the intersection controller 50, a laptop or personal computer 60 and prime power (not shown). The controller processor 40 includes a central processing unit (CPU) 460, a memory 450, which may include a random access and read only memory, a real-time clock (RTC) 440, two serial ports 420, 430, which may be, for example, RS-485 serial ports, a laptop interface 410, which may be, for example, an RS-232 serial interface, preemption outputs 470 and a regulated power supply 480. The CPU 460, in conjunction with the memory 450 runs the real time program which controls the system operation and performs the data processing functions. The RTC 440 provides the CPU 460 with current time-of-day and month-day-year data for time tagging stored intersection preemption events. An on-board battery backup (not shown) maintains the operation of the RTC 440 and a non-volatile section of memory 450 during period when prime power is removed. The CPU 460 communicates with the two RS-485 serial ports 420, 430 to provide full duplex communications with the two intersection unit subassemblies 20, 30. The CPU 460 also communicates with the preemption output interface 470, providing the necessary input discrete commands required for the generation of preemption output commands to the intersection controller 50. The on-board regulated power supply 480 converts the unregulated 20–28 VDC from the intersection controller 40 to regulated +5 VDC on-board power and also passes the unregulated 20–28 VDC to the two intersection unit subassemblies 20, 30.

Figure 10:
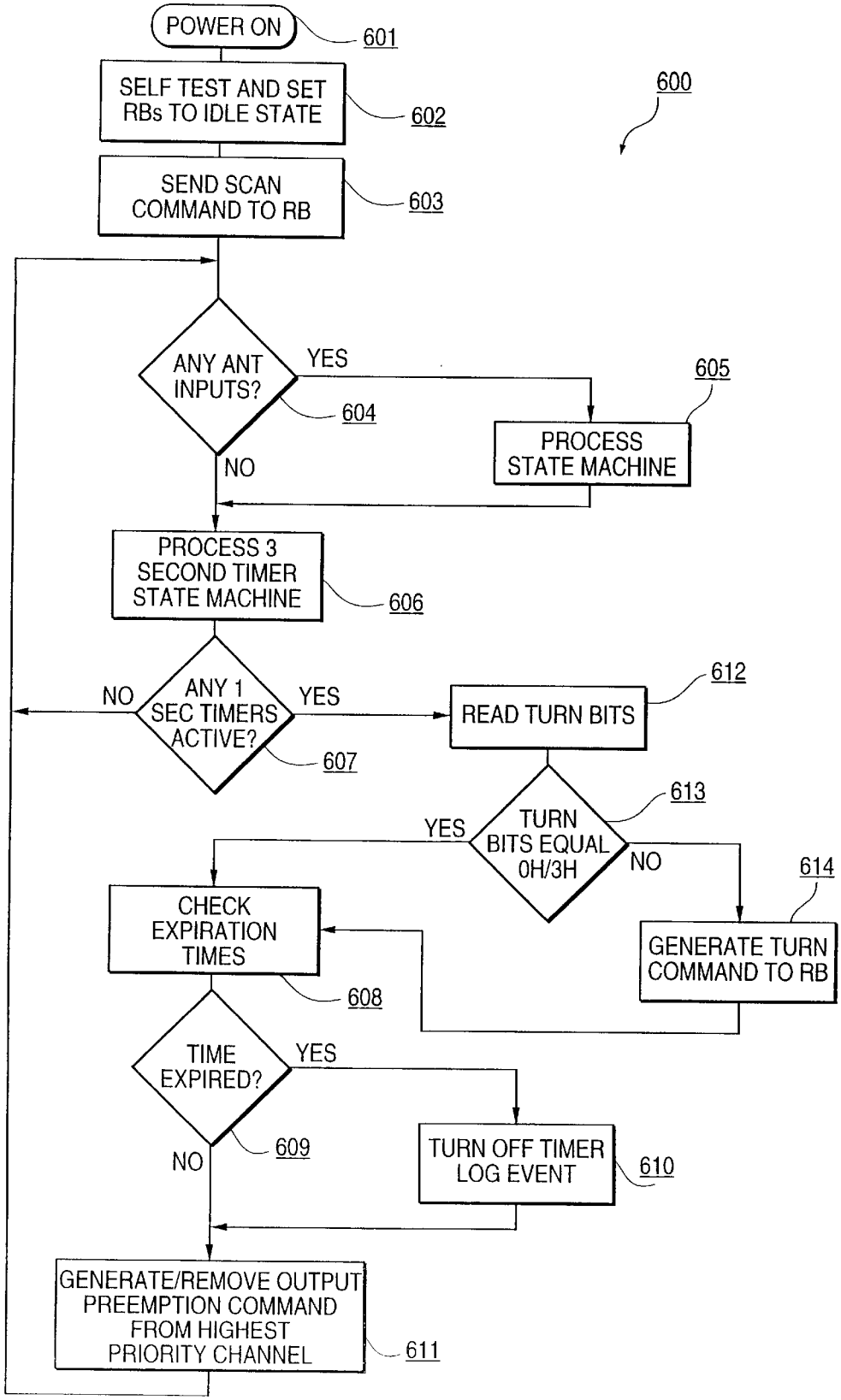
FIG. 10 is a flow chart representing the operation of the controller processor board assembly of the present invention.
Figure 11:
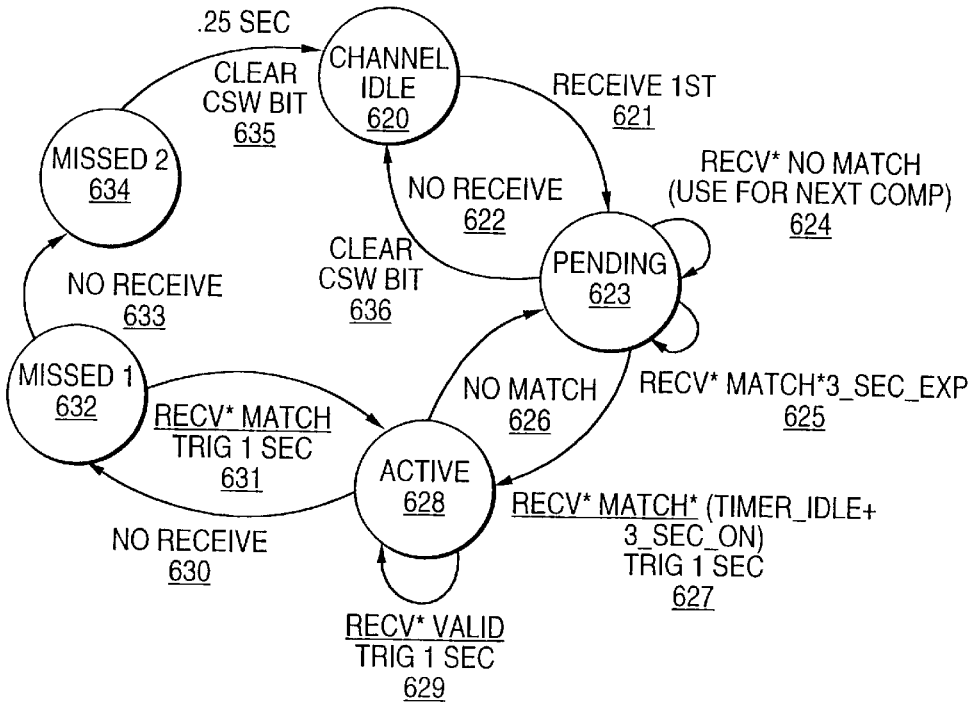
FIG. 11 is a state diagram showing the operational states of the scanned antenna of the present invention.
Figure 12:
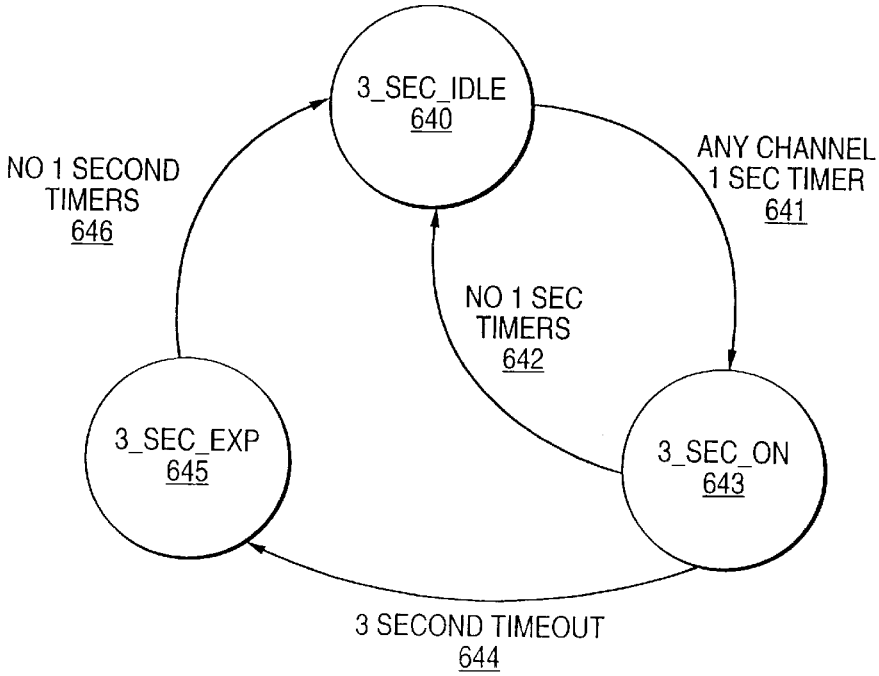
FIG. 12 is a state diagram of the three second timer of the controller processor board of the present invention.

The controller processor 40 data processing is described in FIGS. 10–12. At power up 601, the CPU 460 performs self tests of the digital and analog functions, and sets the receiver processors 260 to the idle state 602. The CPU 460 then sends a scan command to the receiver processors 603 and determines if there are any antenna inputs 604. Valid antenna inputs occur at predetermined intervals, such as, for example, at 0.5 second intervals. If an antenna input is detected 604, the CPU 460 initiates processing the antenna state machine 605 for that particular antenna. Each of the four antennas in the exemplary embodiment of the invention described herein, has a dedicated antenna state machine 605 supporting data processing thereof. If no input is received on a given antenna for a predetermined period of time, such as, for example, 1.25 seconds, the antenna state machine 605 for that antenna is put into the channel idle state 620 awaiting receipt of a message. Upon receiving the first message, receive first 621, the state changes to pending 623. While in the pending state 623, the antenna state machine 605 performs message match comparisons 624, with the result being that if no match occurred, the antenna state machine 605 remains in the pending state 623. Processing continues with the CPU 460 initiating processing of the three second timer state machine 606. If no antenna input has been received for over three seconds, the three second timer state machine 606 is put in the three second idle 640 state. Upon receiving the first message, the process three second timer state machine 606 changes state to three second on 643. While performing the state change, the CPU 460 determines if any channel one second timer 641 is active 607. If there is no one second timer active 607, as is the case after receipt of the first antenna input, processing returns to any antenna inputs 604.

Upon receiving the second antenna input message 604 on the same antenna, the CPU 460 again initiates processing the antenna state machine 605 for that antenna. At this point, the antenna state machine 605 is entered at the pending state 623, where processing performs a message match comparison. If no match is made 624, the antenna state machine 605 returns to the channel idle state 620, thereby clearing the CSW bit 636 to tell the receiver processor 260 to stop expecting receptions on the given antenna. If there is a received match three second expire condition 625, the state machine remains in the pending state. If there is a received match timer idle and three second timer on condition 627, the antenna state machine 605 changes state to an active condition 628. During the state change to the active condition 628, the antenna state machine 605 also triggers the one second timer 627. When in the active state 628, the CPU 460 sets the receiver valid and one second trigger bits. Processing continues with the CPU 460 initiating processing of the three second timer state machine 606. Since an antenna input has been received within the past three seconds, the process three second timer state machine 606 is in the three second on state 643. While processing the process three second timer state machine 606, the CPU 460 determines if any channel one second timer 641 is active 607. If any of the one second timers are active 607, as is the case after receipt of the second antenna input, the CPU 460 reads the turn bits 612. If the turn bits indicate that no turn signal has been initiated 613, processing continues with checking expiration times of any of the one second timers 608. If the turn bits indicate that a turn signal has been activated 613, the CPU 460 generates the required turn command for the receiver processor 614 and returns to check expiration times of any of the one second timers 608. If the time has expired 609, the CPU 460 turns off the one second timer, logs the event 610 and returns to generate output from the highest priority channel 611. In this case, no preemption discrete is generated and processing returns to any antenna input. If the time has not expired 609, as in the case of a valid second message, the CPU 460 generates an output preemption discrete from the highest priority channel 611.

Upon receiving the third antenna input message 604 on the same antenna, the CPU 460 again initiates processing the antenna state machine 605 for that antenna. At this point, the antenna state machine 605 is entered at the active state 628 where processing performs a message match comparison. If there is a match, the CPU 460 sets the receive valid bit 629, retriggers the one second timer 629, and the antenna state machine 605 remains in the active state 628. If there is no match, the antenna state machine 605 changes state to the missed state 632 where it remains until the next received message. The antenna state machine 605 will also change state to the missed state 632 if no message was received 630 at the 0.5 second time where the third message was expected. In any case, processing continues with the CPU 460 initiating processing of the three second timer state machine 606. Since an antenna input has or has not been received within the past three seconds, the process three second timer state machine 606 is in the three second on state 643. While processing the process three second timer state machine 606, the CPU 460 determines if any channel one second timer 641 is active 607. If there are any one second timers active 607, the CPU 460 also reads the turn bits 612. If the turn bits indicate that no turn signal has been activated 613, processing continues with checking expiration times 608 of any one second timers. If the turn bits indicate that a turn signal has been activated 613, the CPU 460 generates the required turn command for the receiver processor 614 and returns to check expiration times of any of the one second timers 608. If the time has expired 609, the CPU 460 turns off the one second timer 610, logs the event, and returns to generate output from the highest priority channel 611. In this case, no preemption discrete is generated and processing returns to any antenna input. If the time has not expired 609, as in the case of a valid third message, the CPU generates an output preemption discrete from the highest priority channel. If the time has not expired 609, as would be the case even if the third message were invalid or not received, processing continues with generate output from the highest priority channel 611, at which time the CPU 460 would remove the output preemption discrete command.

Upon receiving the fourth antenna input message 604 on the same antenna, the CPU 460 again initiates processing the antenna state machine 605 for that antenna. At this point the antenna state machine 605 is entered either at the active state 628 or the missed 1 state 632. If the antenna state machine 605 is entered at the active state 628, the CPU 460 performs a message match comparison. If there is a match, the CPU 460 sets the receive valid bit 629, retriggers the one second timer 629, and the antenna state machine 605 remains in the active state 628. If the antenna state machine 605 is entered at the missed 1 state 632, the CPU 460 performs a message match comparison with the third message received. If there is a match 631, the CPU 460 triggers the one second timer 631, and the antenna state machine 605 returns to the active state 628. If there is no match, the antenna state machine 605 changes state to the missed 2 state 634 where it remains for a predetermined period of time, such as, for example, 0.25 seconds 635 before the antenna state machine 605 clears the CSW bit 635 and changes state to the channel idle state 620. The antenna state machine 605 will also change state to the missed 2 state 634 if no message was received 633 at the 0.5 second epoch where the fourth message was expected. The antenna state machine 605 stays in the missed 2 state 634 for the next 0.25 seconds 635 before the antenna state machine 605 clears the CSW bit 635 and changes state to the channel idle state 620. In any event, processing continues with the CPU 460 initiating processing of the three second timer state machine 606. Since an antenna input has or has not been received in the last three seconds, the process three second timer state machine 606 is in the three second on state 643. While processing the three second timer state machine 606, the CPU 460 determines if any channel one second timer 641 is active 607. If there are any one second timers active 607, as is the case after receipt of the fourth antenna input or message 0.5 second epoch, processing continues by checking expiration times 608 of any one second timers. If the time has expired 609, the CPU 460 turns off the one second timer logs the event 610 and returns to generate output from the highest priority channel 611. In this case, no preemption discrete is generated and processing returns to any antenna input. If the time has not expired 609, as is the case with a valid fourth message, the CPU 460 generates an output preemption discrete from the highest priority channel 611. If the time has not expired 609, as would be the case even if the fourth message was invalid or not received, processing continues with generating output from the highest priority channel 611, at which time the CPU 460 would remove/not generate the output command.

The preceding scenario may occur simultaneously on any one or all of the other three antenna state machines 605 with the generated output from the highest priority channel 611 providing the preemption command. Processing continues until the process three second timer state machine 606 exceeds three seconds and transitions, i.e., three second timeout 644, to the three second expire state 645 at which time the generated output from the highest priority channel 611 is locked to the highest priority antenna channel processed during the three second period. The controller processor 40 continues to process inputs on the selected highest priority antenna channel until the 0.5 second epoch inputs cease, at which time the antenna state machines 605 initially transition from the active state 628 to the missed 1 state 632 and then to the missed 2 state 634, from which it transitions to the channel idle state 620 in the next 0.25 seconds. After processing the missed 2 state 634, the CPU 460 processes the three second timer state machine 606 which remains in the three second expire state 645. The CPU 460 then checks for any one second timers active 607 and their expiration times 608. Since the antenna channel of concern is in the missed 2 state 634, the time is expired on the one second timer of concern. The CPU 460 then turns off the timer 610, logs the event 610, proceeds to remove the preemption command, generates output from the highest priority channel 611, and returns to any antenna inputs 604. At the next antenna input epoch 604, with no one second timers active 646, the process three second timer state machine 606 transitions to the three second idle state 640. Antenna inputs received on other channels are processed by their respective antenna state machines 605 by performing a received match three second expiration test 625, which maintains the state machine for that channel in the pending state 623.

As described above, the preferred embodiment of the system disclosed is a microwave command and control system that provides preemption command discretes to the traffic intersection traffic light controller 50 to effect preemptive control of traffic signals in the path of an emergency vehicle and also to traffic control signal orthogonal to, or not in the direct path of the emergency vehicle. The EVCCS 1 supports preemption command and control in both four-way and two-way intersections.

The method of operation of the EVCCS 1 as an intersection traffic light preemption system is best described by first describing the operation of a typical intersection traffic light. The typical intersection traffic light found in most cities, is generally controlled by the output from a microprocessor based intersection controller. The application program running in the intersection controller typically receives inputs from any one or all of the following three sources: software timers; magnetic sensor loops embedded in the roadway; and preemption command discretes from an emergency vehicle preemption system such as the one described herein.

The EVCCS 1, as described above with respect to FIGS. 1–12 includes a vehicle mounted EVT 10, and intersection installation including two intersection unit subassemblies 20, 30 (see FIG. 1). Each subassembly 20, 30 includes an electronically scanned two antenna 201, 203 array, a pair of associated receiver/transmitters 210, 240 and an associated processor 260 (see FIG. 4). The system further includes a controller processor 40 that is operatively coupled to an intersection controller 50 (see FIG. 1). Upon activation of the EVCCS 1 at the intersection (see FIG. 8), the system performs a series of diagnostic self-tests at power up, after which it initiates an electronic scan of the antenna array (in the preferred embodiment, carried out through a sampling of the outputs from associated receiver transmitter subassemblies 210, 240). If an emergency vehicle approaches the intersection, at a predetermined distance, such as, for example, 0.5 miles, the EVCCS 1 will begin receiving the EVT 10 transmitted message at predetermined intervals, such as, for example, at one-half second intervals. Each of the directions of approach to the intersection may be individually preset to any range, and the distance between the emergency vehicle and the intersection antenna array quantized based on signal strength. During reception of the first preamble bit, the EVCCS 1 determines an initial signal direction-of-arrival, inhibits the electronic scan of the antenna array at the signal direction-of-arrival, and receives the remainder of the message. In the exemplary embodiment described herein, the total time elapsed for this sequence of events is approximately 4.8 milliseconds. Upon receiving the last bit, the electronic scan of the antenna array is once again resumed. If during a succeeding predetermined period of time, such as, for example, 495 milliseconds, a second emergency vehicle approaches from another direction, the system will receive the message from the second emergency vehicle in the same manner as the first vehicle. In both cases, the receiver processor 260 will format and transmit a message to the controller processor 40 containing signal direction-of-arrival, received signal amplitude and the data in the received message. For a predetermined timing period, such as, for example, three seconds, after the first message was received, the EVCCS 1 will continue to process messages from both emergency vehicles. At the conclusion of the three second period, the controller processor 40 will determine the final signal direction-of-arrival for the selected emergency vehicle coded with the highest priority for preemption of the traffic light. Priority may be ranked in any manner by the user, such as, for example, highest to lowest: ambulances; fire engines, police, cars, busses, etc. Once the priority has been determined, the controller processor 40 inhibits the electronic scan of the antenna array at the proper signal direction-of-arrival and commands the receiver processor 260 to "gate", i.e., receive, only the selected emergency vehicle transmissions for processing. The "gating" process also inhibits the reception of transmissions from a second emergency vehicle that may be traveling on the same path, but behind the selected emergency vehicle until the selected emergency vehicle passes through and exits the intersection.

Data processing by the controller processor 40 may also include correlation processing of message pairs to achieve minimum message error rates, software time-outs for the reception of message pairs, the decoding of emergency vehicle turn signal commands, the generation of commands to the receiver processor 260 to directionally transmit a preemption command to an adjacent or orthogonal intersection, i.e., an intersection that is not directly in the path of the emergency vehicle, and the recording of time tagged status records in a memory, such as, for example, a non-volatile memory for each intersection preemption event. The status records are available for download via a laptop or personal computer 60 at any time through the interface with the controller processor 40. The same interface may be used for initial setup of the EVCCS 1 at an intersection, including setting the real time clock, presetting the ranges at which the system will respond to a preemption command on each of the approach paths and the real-time monitoring of the system during initial setup.

The system performs its function by generating a coded command and directionally transmitting the command at predetermined intervals, such as, for example, 0.5 second intervals, at a predetermined burst rate, such as, for example, 3.33 Kbps from the emergency vehicle to an intersection in the path of the emergency vehicle. The intersection in the path of the emergency vehicle receives the command over distances from, for example, 0 to 0.5 miles under all environmental conditions, e.g., rain, snow, fog, etc. The reception function is orchestrated to accurately determine signal direction-of-arrival and to minimize false alarms. The signal direction-of-arrival function is performed by electronically scanning an antenna array at a predetermined rate, such as, for example, 25 KHZ, digitizing the samples at the output of log-linear amplifiers and using greatest-of detection processing by the receiver processor 260 to accurately determine the signal direction-of-arrival from approaching emergency vehicles communicating with the intersection. Received coded pulse-width modulated data is amplitude detected at the receiver 210, 240 and passed to the receiver processor 260 for pulse-width detection and formatting into receive data messages, where the number of messages is dependent upon the number, up to four, of emergency vehicles approaching the intersection from different directions. In the event more than one emergency vehicle approaches the intersection from the same direction, the controller processor 40 will select the vehicle of first contact and command the receiver processor 260 to establish "gating" to discriminate against the other vehicles until the first vehicle has cleared the intersection. Receiver processor 260 formatted messages are immediately transferred to the controller processor 40 for further processing.

The controller processor 40 program executive routine starts the intersection function upon application of power, performs certain power-up diagnostics and initializes the system to commence the antenna scan process to receive the first transmission. The executive routing maintains several timers which establish certain system operating parameters and also generate the preemption discretes that drive the interface to the intersection controller 50. The executive routine also contains branches to any one of many various software state machines that process received messages from up to four emergency vehicle tranmitters. The state machines perform message correlation of paired messages to minimize message error rates, monitors and acts upon the state of the one second timer and provides retriggers to the one second hand timer. The executive routine also contains a branch to read the received turn bit. If a left or right turn command is received, the intersection controller 50 formats and sends a turn command message to the receiver processor 260 which includes the direction-to-transmit and the preemption command message. The receiver processor 260 selects a transmit time and transmits the preemption command message to the adjacent intersection.

While this invention has been described in conjunction with specific embodiments thereof, it is evident that many alternatives, modifications and variations will be apparent to those skilled in the art. Accordingly, the preferred embodiments of the invention, as set forth herein, are intended to be illustrative, not limiting. Various changes may be made without departing from the true spirit and full scope of the invention as defined in the following claims.

What is claimed is:

1. An intersection installation of a traffic signal preemption system, said installation comprising:

a plurality of directional antennas for location at a controlled intersection and reception of preemption signals generated by a mobile transmitter unit approaching in one of plural directions of said controlled intersection;

receiver circuitry operatively connected with said directional antennas for processing signals received by the directional antennas, said processing including: (1) producing output signals corresponding to the received signals; (2) cyclically scanning said output signals at a predetermined rate; (3) processing the scanned output signals to detect the presence or non-presence of a said preemption signal and determine a direction of approach of a mobile transmitter unit associated with a detected preemption signal; and (4) outputting a corresponding data messages for use in generation of preemption commands to be supplied to an intersection controller.

2. An intersection installation according to claim 1, wherein the output signals of the receiver circuitry comprise log-linear and digital data output signals.

3. An intersection installation according to claim 1, wherein:

said plurality of directional antennas comprise a pair of antennas; and said receiver circuitry comprises:

a pair of receiver subassemblies, each sub-assembly serving to process signals received from a respective one of said pair of antennas, and to produce a said output signal corresponding thereto; and a receiver processor operatively connected with said receiver sub-assemblies for performing: said cyclical scanning of the output signals produced by the respective receiver sub-assemblies, said processing of the scanned signals, and said outputting of a corresponding data message.

4. An intersection installation according to claim 3, wherein the output signals of each receiver sub-assembly comprise log-linear and digital data output signals.

5. An intersection installation according to claim 4, wherein said receiver processor performs greatest-of detection processing of said output signals to determine said direction of approach of a mobile transmitter unit associated with a detected preemption signal.

6. An intersection installation according to claim 3, wherein said pair of antennas and said receiver circuitry are physically configured together as an intersection unit sub-assembly mountable on a traffic light standard of said controlled intersection.

7. An intersection installation according to claim 6, said installation comprising a pair of said intersection unit sub-assemblies.

8. An intersection installation according to claim 1, further comprising a controller processor including a plurality of antenna state machines, one corresponding to each of said plurality of antennas, said antenna state machines functioning to progress and regress between a channel idle state and a channel active state based on a sequence of said data messages received from said receiver circuitry, said controller processor generating/removing a said preemption command based, at least in part, upon the states of the antenna state machines.

9. An intersection installation according to claim 8, wherein generation/removal of a preemption command by said controller processor is further based upon a relative priority ranking amongst simultaneously received preemption signals included in said data messages.

10. An intersection installation according to claim 8, wherein each said state machine comprises a pending state that is passed-through on progression of the machine from the channel idle state to the channel active state.

11. An intersection installation according to claim 8, wherein each said state machine comprises at least one intermediate state that is passed-through on a regression of the state machine from the channel active state to the channel idle state.

12. An intersection installation according to claim 8, wherein:

said plurality of directional antennas comprise two pairs of antennas;

said receiver circuitry comprises:

two pairs of receiver sub-assemblies, each receiver sub-assembly serving to process signals received from a respective antenna of said two pairs of antennas, and to produce output signals corresponding thereto;

a pair of receiver processors, each operatively connected with one of said two pairs of receiver sub-assemblies for performing said cyclical scanning of the output signals produced by the respective receiver sub-assemblies, said processing of the scanned signals, and said outputting of a corresponding data message; and said antenna state machine receives said data messages from each of said pair of receiver processors.

13. An intersection installation according to claim 1, wherein a threshold signal level for detecting the presence of a said preemption signal is individually presettable in order to control the maximum distance of the mobile transmitter from the controlled intersection at which traffic signal preemption can occur.

14. An intersection installation according to claim 13, further comprising a controller processor including an computer interface allowing said presetting of the threshold signal level using a portable computer.

15. An intersection installation according to claim 14, wherein said controller processor comprises a memory for storing status records of the installation, including a record of preemption events, and the computer interface allows the status records to be downloaded to the portable computer.

16. An intersection installation of a traffic signal preemption system, said installation comprising:

a plurality of directional antennas for location at a controlled intersection and reception of preemption signals generated by a mobile transmitter unit approaching in one of plural directions of said controlled intersection;

receiver circuitry operatively connected with said directional antennas for processing signals received by the directional antennas to produce corresponding data messages for use in generation of preemption commands to be supplied to an intersection controller; and a controller processor including a plurality of antenna state machines, one corresponding to each of said plurality of antennas, said antenna state machines functioning to progress and regress between a channel idle state and a channel active state based on a sequence of said data messages received from said receiver circuitry, said controller processor generating/removing a said preemption command based, at least in part, upon the states of the antenna state machines.

17. An intersection installation according to claim 16, wherein generation/removal of a preemption command by said controller processor is further based upon a relative priority ranking amongst simultaneously received preemption signals included in said data messages.

18. An intersection installation according to claim 16, wherein each said state machine comprises a pending state that is passed-through on progression of the state machine from the channel idle state to the channel active state.

19. An intersection installation according to claim 16, wherein each said state machine comprises at least one intermediate state that is passed through on the regression of the state machine from the active state to the channel idle state.

20. An intersection installation according to claim 16, wherein:

said plurality of directional antennas comprise two pairs of antennas;

said receiver circuitry comprises:

two pairs of receiver sub-assemblies, each sub-assembly serving to process signals received from a respective antenna of said two pairs of antennas, and to produce output signals corresponding thereto;

a pair of receiver processors, each operatively connected with one of said two pairs of receiver sub-assemblies for processing the output signals from the respective receiver sub-assemblies, and outputting corresponding data messages; and said antenna state machine receives said data messages from each of said pair of receiver processors.

21. An intersection installation of a traffic signal preemption system, said installation comprising:

a plurality of directional antennas for location at a controlled intersection, at least one of said antennas serving as a receive antenna to receive preemption signals generated by a mobile transmitter unit approaching in one of plural directions of said controlled intersection, and at least one of said antennas serving as a transmit antenna;

receiver circuitry operatively connected with said at least one antenna serving as a receive antenna, for processing said preemption signals to produce corresponding data messages including data indicating the presence or absence of an emergency vehicle turn signal command;

transmitter circuitry operatively connected with said at least one antenna serving as a transmit antenna; and a controller processor for receiving and processing said data messages, and, based thereon, (1) generating/removing preemption commands to be supplied to a first intersection controller for the controlled intersection, and (2) causing said transmitter circuitry to output a preemption signal for transmission, via said transmit antenna, to a second intersection controller located at an adjacent or orthogonal intersection.

22. An intersection installation according to claim 21, wherein said at least one antenna serving as a transmit antenna also serves as a said receive antenna.

23. An intersection installation according to claim 22, wherein each of said plurality of directional antennas is a receive/transmit antenna.

24. An intersection installation according to claim 23, comprising an intersection unit subassembly mountable on a traffic light standard, said subassembly including:

a pair of said receive/transmit antennas;

said receiver circuitry; and said transmitter circuitry.

25. An intersection installation according to claim 24, wherein said receiver circuitry and transmitter circuitry of each intersection unit subassembly comprise:

a pair of receiver/transmitter subassemblies operably connected, respectively, with said pair of receive/transmit antennas; and a processor operably connected to said pair of receiver/transmitter subassemblies.

26. An intersection installation according to claim 21, wherein said receiver circuitry cyclically scans said output signals at a predetermined rate and processes the scanned output signals to: (1) detect the presence or non-presence of a said preemption signal, and (2) determine a direction of approach of a mobile transmitter unit associated with a detected preemption signal.

27. An intersection installation according to claim 21, wherein said controller processor includes a plurality of antenna state machines, one corresponding to each of said plurality of antennas, said antenna state machines functioning to progress and regress between a channel idle state and a channel active state based on said data messages produced by said receiver circuitry, said controller processor generating/removing a said preemption command based, at least in part, upon the states of the antenna state machines.

* * * * *